US006688808B2

(12) United States Patent
Lee

(10) Patent No.: US 6,688,808 B2
(45) Date of Patent: Feb. 10, 2004

(54) PREFABRICATED CEMENT CONCRETE SLAB FOR ROAD PAVEMENT

(76) Inventor: Hee Jang Lee, 101-1105 Beoksan Apartment 926-7 Mok-1dong, Yangcheon-ku, Seoul (KR)

( * ) Notice: Subject to any disclaimer, the term of this patent is extended or adjusted under 35 U.S.C. 154(b) by 0 days.

(21) Appl. No.: 10/170,120

(22) Filed: Jun. 12, 2002

(65) Prior Publication Data

US 2003/0231929 A1 Dec. 18, 2003

(51) Int. Cl.[7] ..... E01C 5/06
(52) U.S. Cl. ..... 404/40; 404/34; 404/36
(58) Field of Search ..... 404/34, 36, 37, 404/39, 40; 14/73

(56) References Cited

U.S. PATENT DOCUMENTS 2,251,672 A * 8/1941 Friberg ..... 264/31
3,272,269 A * 9/1966 Murphy ..... 177/126
4,324,504 A * 4/1982 Cottingham et al. ..... 404/74
4,376,596 A * 3/1983 Green ..... 404/35
4,453,283 A * 6/1984 Fitzgerald-Smith et al. ... 14/73
4,470,719 A * 9/1984 Dziark et al. ..... 404/75
5,513,927 A * 5/1996 Baker et al. ..... 404/47
5,685,666 A * 11/1997 Marshall et al. ..... 404/40
5,971,655 A * 10/1999 Shirakawa ..... 404/40

* cited by examiner

*Primary Examiner*—Robert E. Pezzuto
*Assistant Examiner*—Raymond W Addie
(74) *Attorney, Agent, or Firm*—Dickinson Wright PLLC

(57) ABSTRACT

A prefabricated cement concrete slab for road pavement by which rapid and convenient construction and repair and maintenance can be achieved and which is durable and cost effective. Prefabricated cement concrete slab units each being a size adapted to the width of a roadway can be easily transported to a construction site by means of a lifting equipment installed on each slab unit. Also, a connection equipment is installed for fixedly connecting the respective slab units without being moved with respect to each other or the ground. Watertight members for preventing infiltration of water into the ground are installed between neighboring slab units connected continuously. Therefore, the road pavement using the cement concrete slab units can be easily repaired and maintained in a cost-effective way. Also, the appearance of the road can be improved and an even road surface can be attained.

14 Claims, 10 Drawing Sheets

PREFABRICATED CEMENT CONCRETE SLAB FOR ROAD PAVEMENT

BACKGROUND OF THE INVENTION

1. Field of the Invention

The present invention relates to a prefabricated cement concrete slab for road pavement, and more particularly, to a prefabricated cement concrete slab by which road pavement and repair and maintenance can be rapidly and easily performed, thereby ensuring improved constructability, durability and cost-effectiveness.

2. Description of the Related Art

In general, asphalt concrete type road pavement (to be referred to as 'asphalt pavement') and cement concrete type road pavement (to be referred to as 'cement pavement') have been typically used.

In particular, asphalt pavement mainly used for road pavement has unavoidable problems such as rutting, shoving, fatigue crack or low-temperature crack, according to climate conditions, vehicular running conditions, e.g., vehicular traffic or heavy vehicle passing ratio, or characteristics of pavement materials. During the period of repair and maintenance required in the event of occurrence of such problems, there is a need of restricting vehicles running on the roadway or vehicles must be run on detours, causing traffic congestion or a rise in logistic costs. In particular, a rise in the temperature of a pavement surface in the summer season may cause deformation to a pavement material, e.g., rutting, resulting in a spoiled appearance of the pavement material, inconvenience in the vehicular traffic or water gathering. The deformed pavement material rapidly gives rise to damages to paved roadway, thereby increasing the repair cost. In actuality, repair and maintenance works of road pavement are being performed nationwide almost every year.

To overcome the above-described problems with asphalt pavement, cement pavement is widely being used, as is known well. The asphalt pavement is cost effective in that it is less deformed or damaged, consuming less repair and maintenance costs. However, the asphalt pavement still has disadvantages including technical difficulty, curing period, long-term traffic regulation during the curing period for repair and maintenance and so on.

SUMMARY OF THE INVENTION

To solve the above-described problems, it is an object of the present invention to provide a prefabricated cement concrete slab for road pavement, which has improved constructability for cement pavement and enhanced durability, by allowing prefabricated cement concrete slab units, which are manufactured at a concrete plant and then transported to the construction site to be assembled.

To accomplish the above object of the present invention, there is provided a prefabricated cement concrete slab for road pavement, in a roadway treated with a previous compaction work, including rectangular cement concrete slab units prefabricated into a transportable size adapted to the width of a lane, and configured for road pavement by horizontally arranging neighboring slab units along a roadbed, lifting means providing latching holes integrally formed in the respective slab units for transporting the slab units, connecting means positioned on a roadbed facing joint portions of the neighboring slab units for fixedly connecting the slab units without being moved, and a tube mounted inside a cylindrical structure formed by hemispherical grooves formed at one-side lateral surfaces of the neighboring slab units horizontally connected by the connecting means, and having a valve for filling air or a watertight filler for providing watertightness to the slab units.

Preferably, each of the lifting means includes a support plate having a predetermined area and horizontally buried into the slab unit, a support tube integrally welded to the support plate and buried into the slab unit to form an accommodating groove opened outward through an opening, the accommodating groove having an openable cap threaded thereto, and a latching device having a latching hole inside the accommodating groove firmly welded on the support plate and the latching device being exposed outward through the opening when the cap is opened.

Also, each of the lifting means may include a support plate having a predetermined area and horizontally buried into the slab unit, a support tube integrally welded to the support plate and buried into the slab unit to form an accommodating groove opened outward through an opening, the accommodating groove having an openable cap threaded thereto, and a latching device having a latching hole inside the accommodating groove separably threaded to a thread rod firmly welded on the support plate and the latching device being exposed outward through the opening when the cap is opened.

Alternatively, each of the lifting means may include a support plate having a predetermined area and horizontally buried into the slab unit, a support tube integrally welded to the support plate and buried into the slab unit to form an accommodating groove opened outward through an opening, the accommodating groove having an openable cap threaded thereto, and a latching device having a latching hole having a recessed groove formed on the top surface of the cap to have a predetermined area and pivotally supported to the inner wall of the recessed groove to lie down inside the recessed groove.

Preferably, the concrete slab further includes a hole for opening/closing on the top surface of the cap.

Also, each of the connecting means preferably includes an accommodating groove formed on a base facing a portion adjacent to the slab units, a rectangular connection plate coplanarly accommodated in an accommodating groove and having insertion pins protruding thereon, and an insertion equipment installed at a portion facing the connection plate of the slab unit and having insertion holes into which the insertion pins are inserted.

Preferably, a wall for providing watertightness is further provided between the slab units in a straight-line form or cross form.

Alternatively, the concrete slab may further include a bar-shaped reinforcement member further installed along the outer periphery of the insertion equipment.

The connection means preferably includes an accommodating groove formed on the bottom portions of the neighboring slab units, a recessed member formed in the accommodating groove, a rectangular base panel coplanarly accommodated in the accommodating groove, and a projecting member integrally extending from both sides of the base panel.

Preferably, the valve includes an orifice formed on the tube, and a shield plate installed around the orifice, for opening/closing the orifice.

Also, the concrete slab may further include a filler for providing watertightness between connection surfaces of each of the respective slab units.

Preferably, a space for installing manhole covers for water supply or sewage systems is further provided in each slab unit.

According to the road pavement of the present invention, constructability can be improved and durability can be enhanced.

BRIEF DESCRIPTION OF THE DRAWINGS

The above objects and advantages of the present invention will become more apparent by describing in detail preferred embodiments thereof with reference to the attached drawings in which:

FIG. 5*f* is a partially extracted perspective view of FIG. 5*e;*

DETAILED DESCRIPTION OF THE INVENTION

A prefabricated cement concrete slab according to a preferred embodiment of the present invention will now be described in detail with reference to the accompanying drawings.

Figure 1:
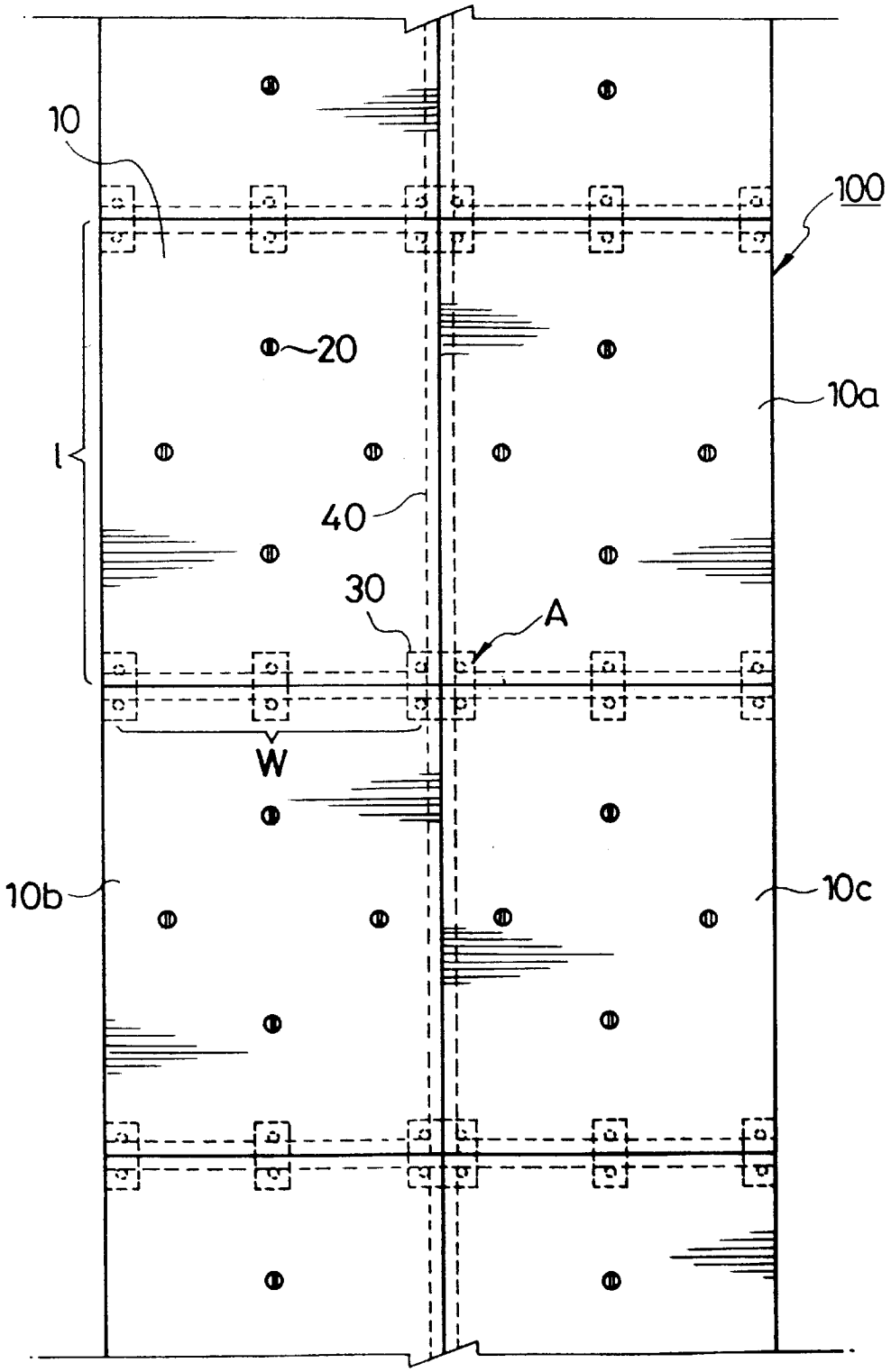
FIG. 1 is a top view schematically showing the state in which a prefabricated cement concrete slab for road pavement according to the present invention.

FIG. 1 is a top view schematically showing the state in which a prefabricated cement concrete slab for road pavement according to the present invention.

Reference numeral 100 denotes a 2-lane cement pavement by assembling prefabricated cement concrete slab for road pavement according to the present invention (to be referred to as 'slab units 10, 10*a*, 10*b*, 10*c*, hereinafter). The cement pavement 100 may be a one or more-lane road according to the increasing number of the slab units 10, 10*a*, 10*b*, 10*c* as easily understood from in FIG. 1.

The respective slab units 10, 10*a*, 10*b*, 10*c* constituting the cement pavement 100 are all the same in view of structure and function, and a detailed explanation will now be made with only the slab unit 10 by way of example. The slab unit 10 is mass-produced using cement, aggregate and steel in a separate plant equipment (not shown). The slab unit 10 is completed into a high-quality, standardized product such that various members including a lifting equipment and a connection equipment, which will later be described, and reinforcement members are installed inside a mold (not shown) made of general steel and concrete is poured thereinto and cured.

The fabrication of the slab unit 10 is a generally known technology and a detailed explanation thereof will not be given. The width (W) of the slab unit 10 is the same as a predetermined road width, i.e., approximately 3.5 m, the length (l) thereof is in the range from approximately 6.5 to 13 m, and the height (h), best seen in FIG. 2, thereof is high enough to withstand the weight of a vehicle, that is, approximately 0.2 to 0.3 m. The length (l) of the slab unit 10 can be arbitrarily adjusted within the possible transportation range, preferably as long as possible for construction convenience. In the slab unit 10 provided is a space in which a lifting equipment 20, a connection equipment 30 and a tube 40 for providing watertightness, integrally formed in the mold (not shown), which will later be described in detail with reference to FIGS. 2 through 13.

Figure 2:
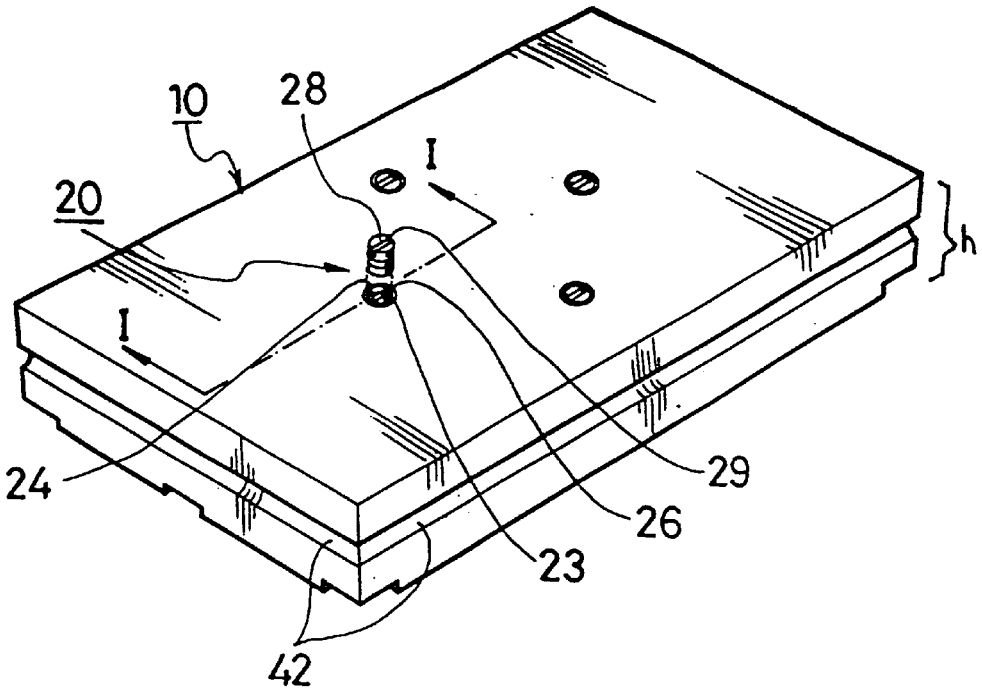
FIG. 2 is an enlarged perspective view of a cement concrete slab unit shown in FIG. 1.
Figure 4:
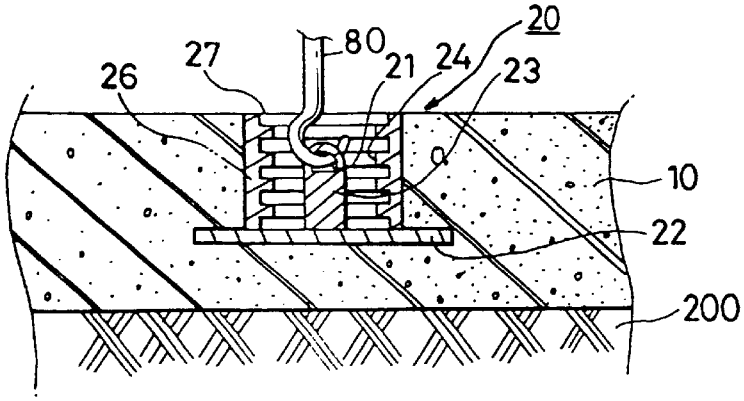
FIG. 4 is a partially enlarged, sectional view of FIG. 2, taken along the line I—I shown in FIG. 2, illustrating an example of a lifting equipment employed to the cement concrete slab according to the present invention.

FIG. 2 is an enlarged perspective view of a cement concrete slab unit shown in FIG. 1, and FIG. 4 is a partially enlarged, sectional view of FIG. 2, taken along the line I—I shown in FIG. 2, illustrating an example of a lifting equipment employed to the cement concrete slab according to the present invention.

At least four lifting equipments 20 for facilitating transportation of the slab unit 10 are provided in the slab unit 10. The lifting equipments 20 are used to receive a hook 80 (see FIG. 4) of a transportation means such as a crane when the slab unit 10 is carried, placed or withdrawn, and is integrally formed within the slab unit 10 at the time of fabricating the slab unit 10. Also, the lifting equipments 20 are so constructed as to withstand the weight of the slab unit 10. The illustrated lifting equipments 20 are all the same in view of structure and function, and only one of the lifting equipments 20 will be explained by way of example.

As shown in FIG. 4, the lifting equipment 20 is provided with a metal support plate 22 having a predetermined area and horizontally buried into the slab unit 10. To the support plate 22 is integrally welded a support tube 26 having a thread groove 24 opened outward through an opening 27. A latching device 23 having a latching hole 21 inside the thread groove 24 of the support tube 26 is firmly welded on the support plate 22 to a height not exceeding the thread groove 24. The thread groove 24 of the support tube 26 is openably closed by a cylindrical thread cap 28, making the thread cap 28 be level with the slab unit 10 (see FIG. 2). When the thread cap 28 is opened, the latching device 23 is exposed outward by the opening 27 so that the hook 80, e.g., a crane, is fitted into the latching hole 21. As shown in FIG. 2, a driver groove 29 is formed on the surface of the thread cap 28 for the purpose of allowing the thread cap 28 to be easily disconnected from or connected to the thread groove 24. The driver groove 29 may take either a straight-lined or cross form.

In order to prevent the lifting equipment 20 from being frozen to rupture or corroding due to infiltration of water, grease may be filled into the support tube 26.

Although it has been described that four lifting equipments 20 are installed in the slab unit 10 according to the present invention, the number of the lifting equipments can be adjusted according to the size of the slab unit 10. Also, the lifting equipments 20 are preferably formed of a metal so as to impart a predetermined strength thereto. In FIG. 4, reference numeral 200 denotes a roadbed.

Figure 5A:
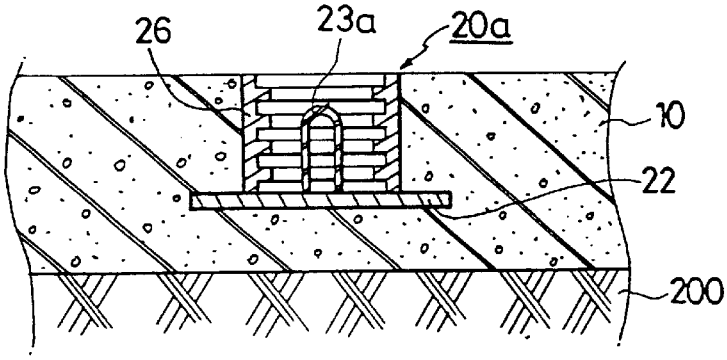
FIGS. 5*a* through 5*f* are sectional views of other examples of the lifting equipment shown in FIG. 4, viewed in the same direction as in FIG. 4.
Figure 5B:
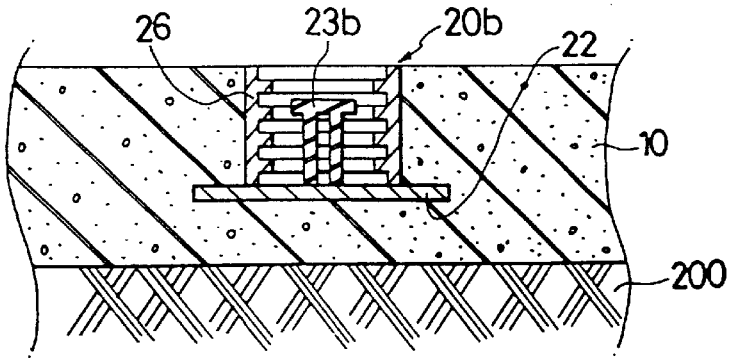
Figure 5C:
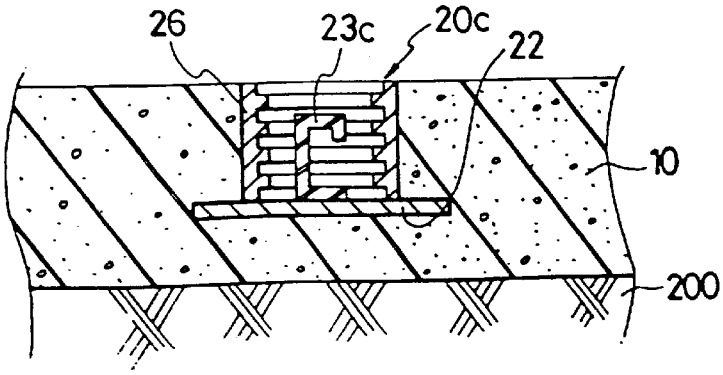
Figure 5D:
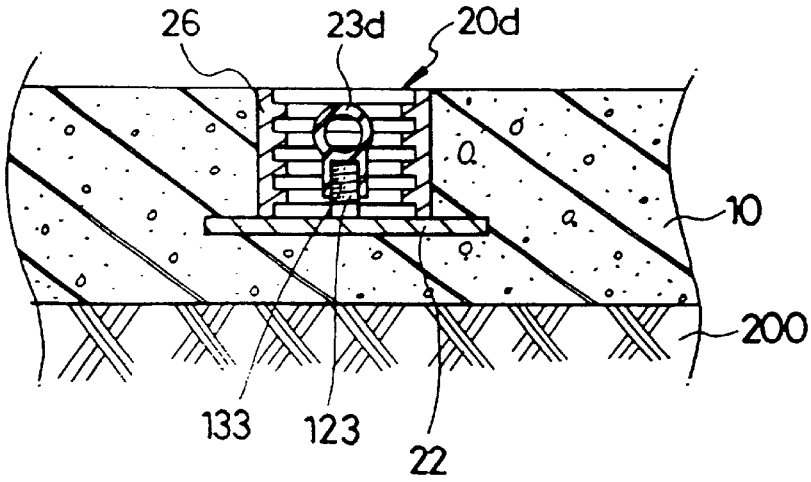
Figure 5E:
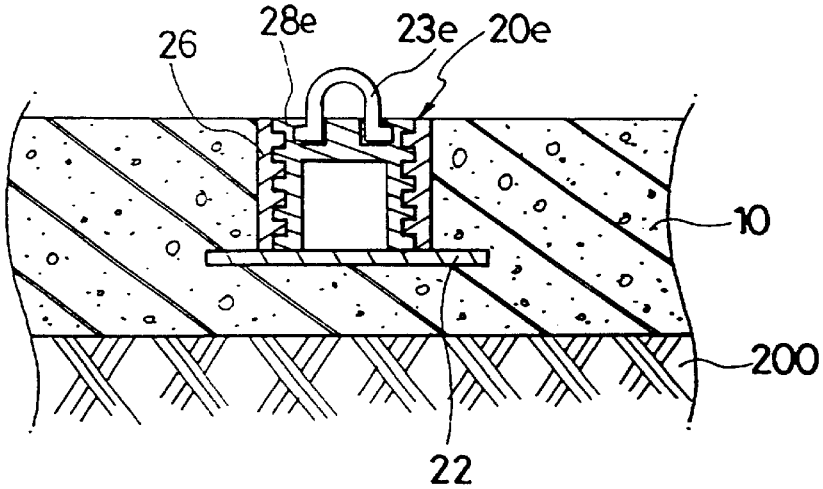
Figure 5F:
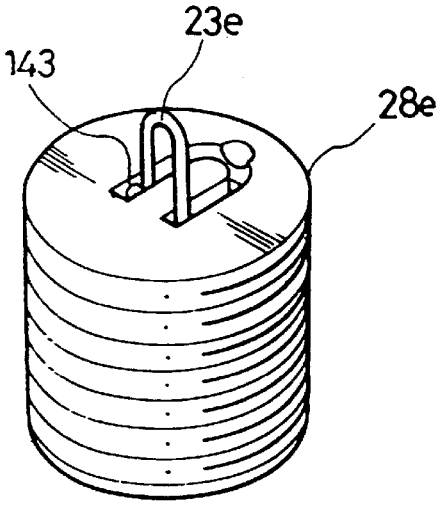

FIGS. 5*a* through 5*e* are sectional views of other examples of the lifting equipment shown in FIG. 4, viewed in the same direction as in FIG. 4, and FIG. 5*f* is a partially extracted perspective view of FIG. 5*e*. Here, the same functional elements as those of the above-described embodiment are indicated by the same reference numerals.

FIG. 5*a* shows a ring-shaped latching device 23*a* of a lifting equipment 20*a*, and FIG. 5*b* shows a stud-shaped latching device 23*b* of a lifting equipment 20*b*, both latching devices 23*a* and 23*b* being integrally welded to the support plate 22. FIG. 5*c* shows a one-side opened rectangle-shaped latching device 23*c* of a lifting equipment 20*c*. FIG. 5*d* shows a latching device 23*d* of a lifting equipment 20*d*, the latching device 23*d* being separably threaded with a thread rod 123 welded to the support plate 22 and having a thread groove 133 for being coupled to the thread rod 123.

FIGS. 5*e* and 5*f* show a latching device 23*e* of a lifting equipment 20*e*, pivotally supported on the inner wall of an accommodating groove 143 formed on the top surface of the thread cap 28*e*. When the latching device 23*e* is not used, it is accommodated inside the accommodating groove 143. Since the thread cap 28*e* can be removed just by taking hold of and rotating the latching device 23*e*, a separate driver groove is not required. The other configurations are the same as those of the above-described embodiment.

Figure 3:
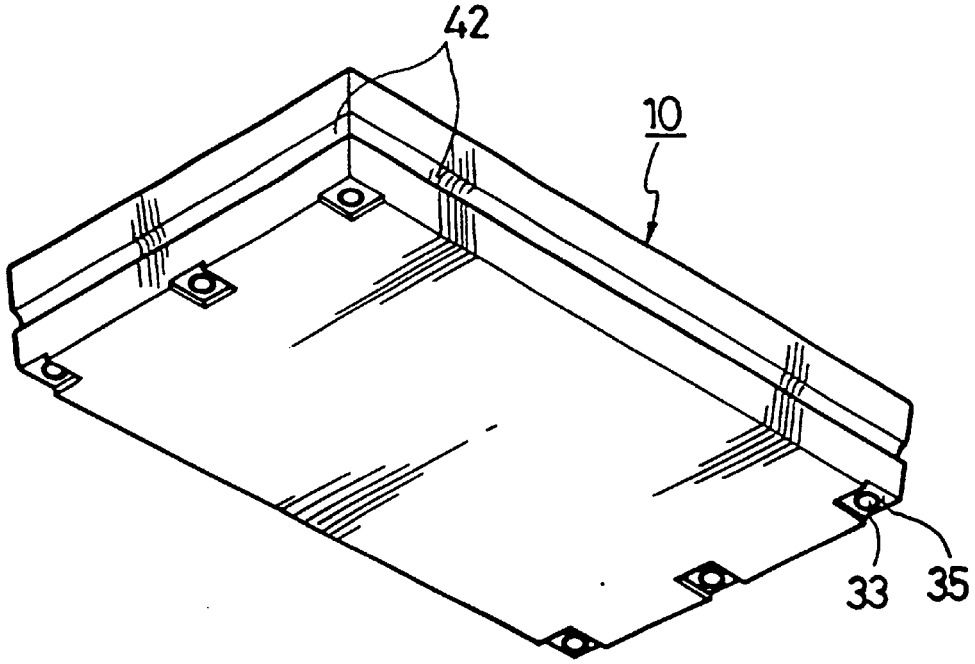
FIG. 3 is a bottom, perspective view of the cement concrete slab shown in FIG. 2.
Figure 6:
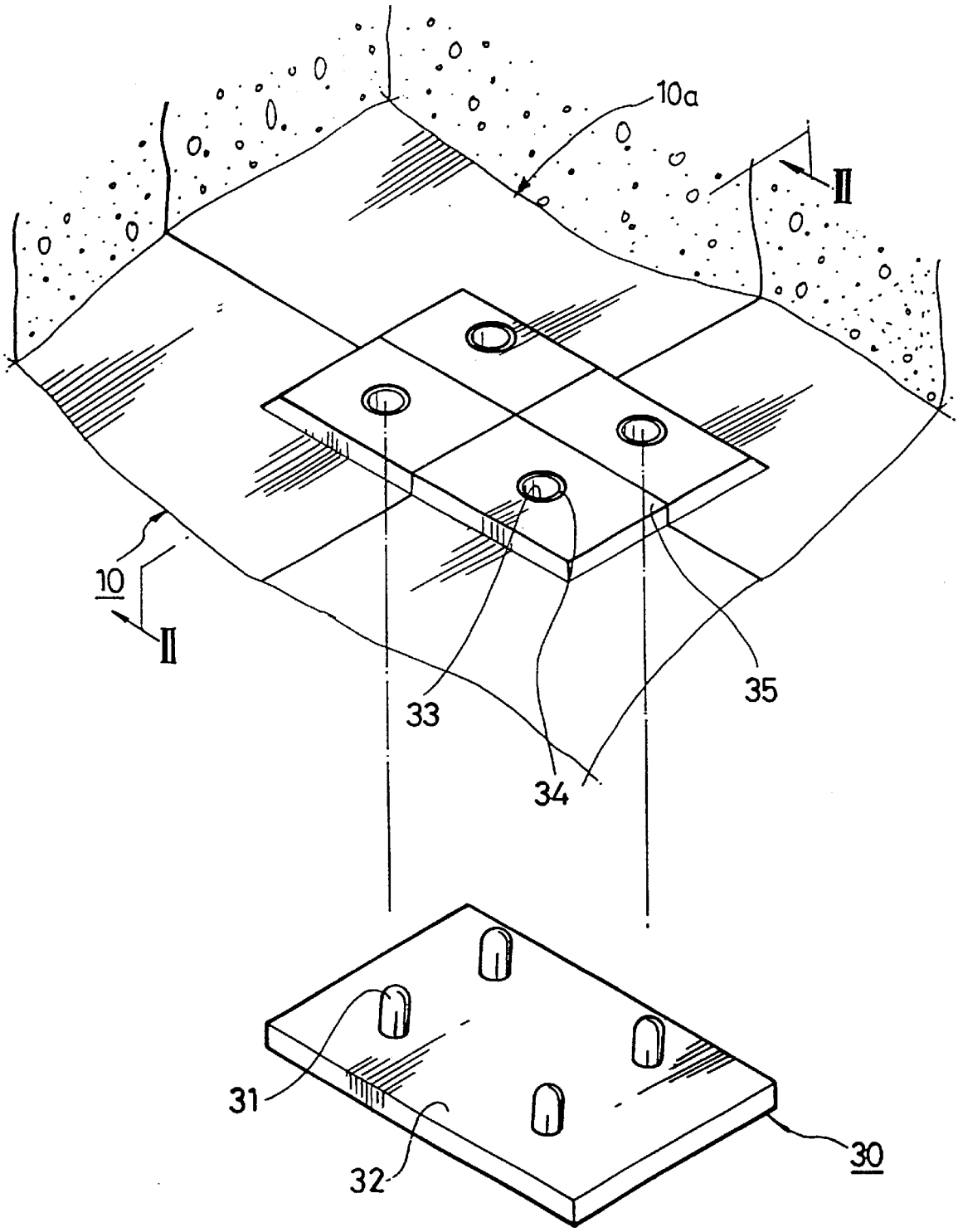
FIG. 6 is a bottom, partially enlarged, perspective view of a portion A shown in FIG. 1.
Figure 7:
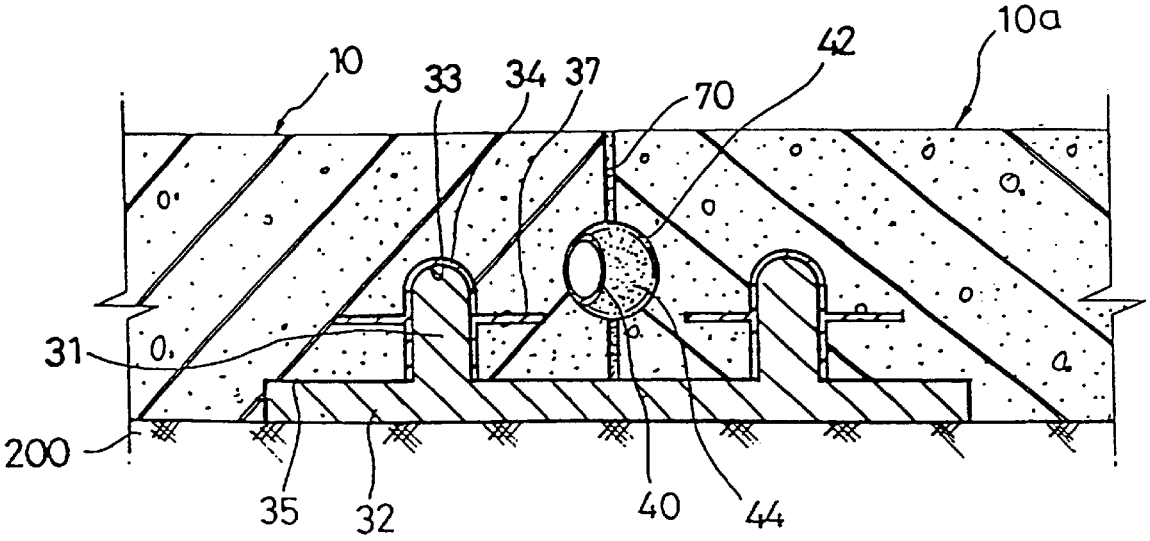
FIG. 7 is an enlarged sectional view of FIG. 6 , taken along the line II—II, showing another example of a connection equipment employed to the cement concrete slab according to the present invention.

FIG. 3 is a bottom, perspective view of the cement concrete slab shown in FIG. 2, FIG. 6 is a bottom, partially enlarged, perspective view of a portion A shown in FIG. 1, and FIG. 7 is an enlarged sectional view of FIG. 6, taken along the line II—II, showing another example of a connection equipment employed to the cement concrete slab according to the present invention.

Here, a connection equipment 30 used for fixedly assembling the slab unit 10 to a roadbed 200 previously treated with a compaction work. The connection equipment 30 includes a rectangular connection plate 32 made of a metal having at least two insertion pins 31 protruding thereon, the connection equipment 30 being positioned on a base facing a portion adjacent to the slab unit 10 (see FIG. 6).

A tubular, metallic insertion equipment 34 is installed at each edge of the slab unit 10, that is, at either side of the width of the slab unit 10, to provide an insertion groove 33 for fittingly inserting an insertion pin 31 of the connection plate 32. Like the lifting equipment 20, the insertion equipment 34 is disposed within a mold (not shown) during formation of the slab unit 10 to then be integrally formed with the slab unit 10. A reinforcement member 37 for firmly supporting the insertion equipment 34 without being moved inside the slab unit 10, is formed along the periphery of the insertion equipment 34. An accommodating groove 35 for accommodating the connection plate 32 so as to be level with the bottom surface of the slab unit 10, is installed around the insertion equipment 34 (See FIGS. 3 and 6). The accommodating groove 35 has a size suitable to accommodate the connection plate 32.

The above-described connection plate 32 of the connection equipment 30 is first placed on the roadbed 200 previously treated with a compaction work. In order to enhance the planarity of the slab unit 10, the roadbed 200 is preferably subjected to a compaction work after forming an asphalt binder layer. A compaction work of the asphalt binder layer is based on the standard specification of road construction.

Each connection plate 32 is positioned on the roadbed 200 to correspond to each insertion equipment 34 of the slab unit 10. The slab unit 10 is transported to a construction site by a crane, for example, to be assembled, such that the insertion pin 31 of the connection plate 32 is inserted into the insertion equipment 34 of the slab unit 10. The connection equipment 30 connects neighboring slab units 10, 10*a*, 10*b* and 10*c* horizontally and vertically according to the dimension of traffic lane and improves adhesion between each of the respective slab units and the roadbed 200, by the load of the slab units. Thus, the connection equipment 30 serves to resist the horizontally moving behaviors of the slab units and controlling elongation of the slab units due to a change in volume. The connection plate 32 can be installed at horizontal and vertical connection points of the slab units. Also, the connection plate 32 may be installed at a vertical connection point, a horizontal connection point, at horizontal and vertical corners or at the bottom center of the slab units. In some cases, the connection plate 32 may be installed throughout the bottoms of the slab units. The connection plate 32 shown in FIG. 6 is of a bi-directional type used for integrally connecting at least four comers of the neighboring slab units vertically and horizontally.

Figure 8A:
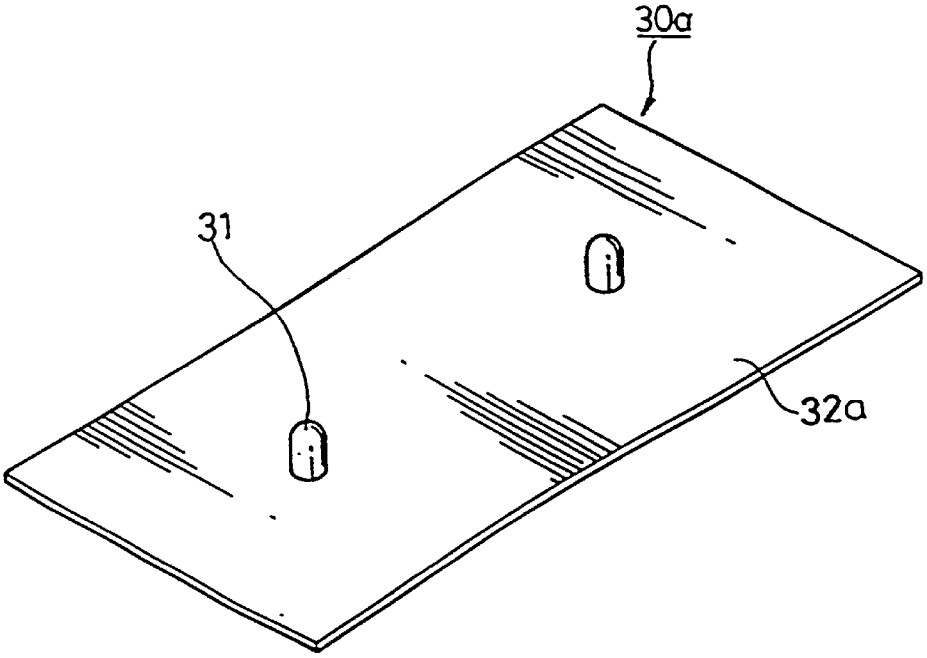
FIGS. 8*a* through 8*c* are perspective views of other examples of the connection equipment shown in FIG. 7.
Figure 8B:
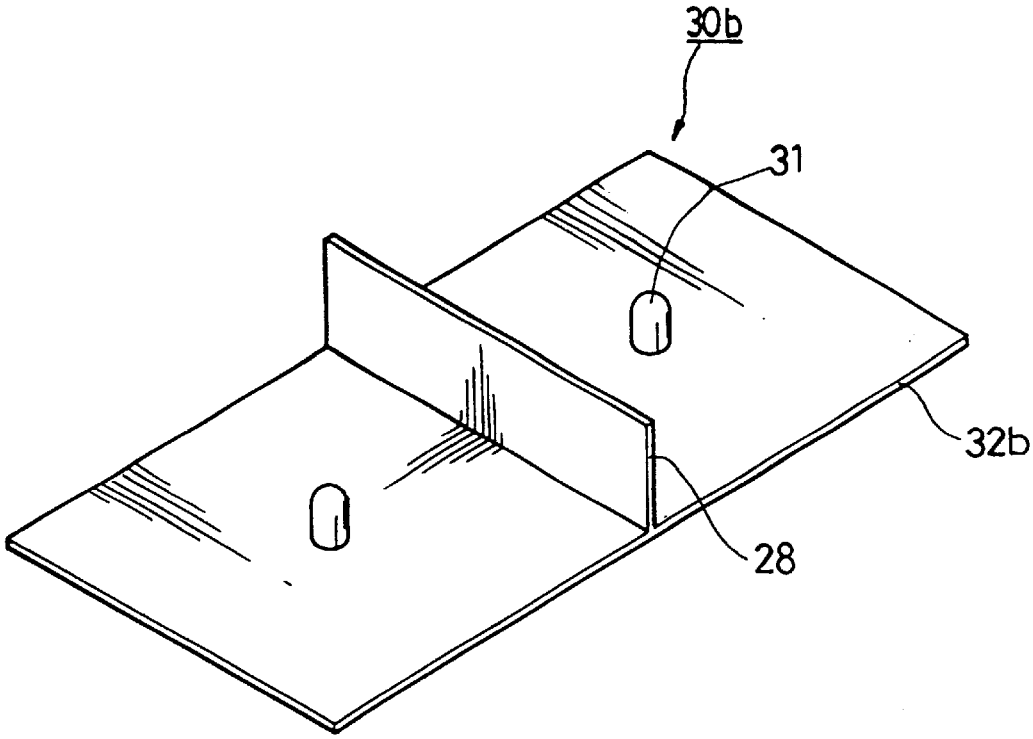
Figure 8C:
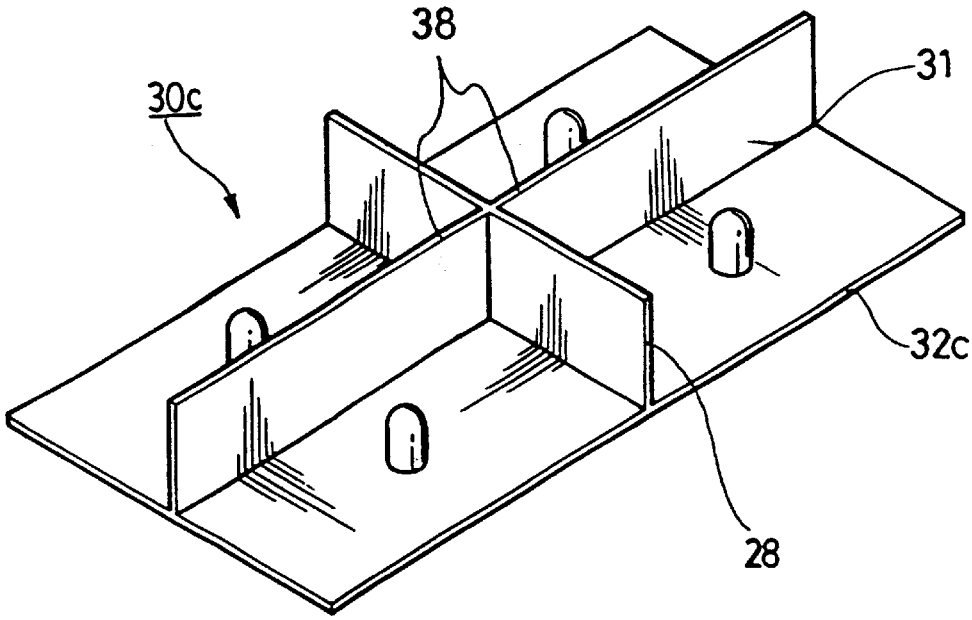

FIGS. 8*a* through 8*c* are perspective views of other examples of the connection equipment shown in FIG. 7, in which the same functional elements as those of the above-described embodiments are indicated by the same reference numerals.

A connection plate 32*a* of a connection equipment 30*a* shown in FIG. 8*a* is of a uni-directional type, by which at least two portions of neighboring slab units 10 are connected. FIG. 8*b* shows the connection plate 32*b* of the connection equipment 30*b* used for the same purpose as that shown in FIG. 8*a*, and FIG. 8*c* shows a connection plate 32*c* used for the same purpose as that shown in FIG. 6, respectively, with the exception of walls 38 being further provided. The respective walls 38 are positioned between each of neighboring slab units 10 to resist the horizontally moving behavior of the respective slab units 10. The sizes of the above-described connection plates 32, 32*a*, 32*b* and 32*c* are determined by the weight of each slab unit 10. The installation intervals of the connection plates 32, 32*a*, 32*b* and 32*c* are also determined by the weight of each slab unit 10.

Figure 9:
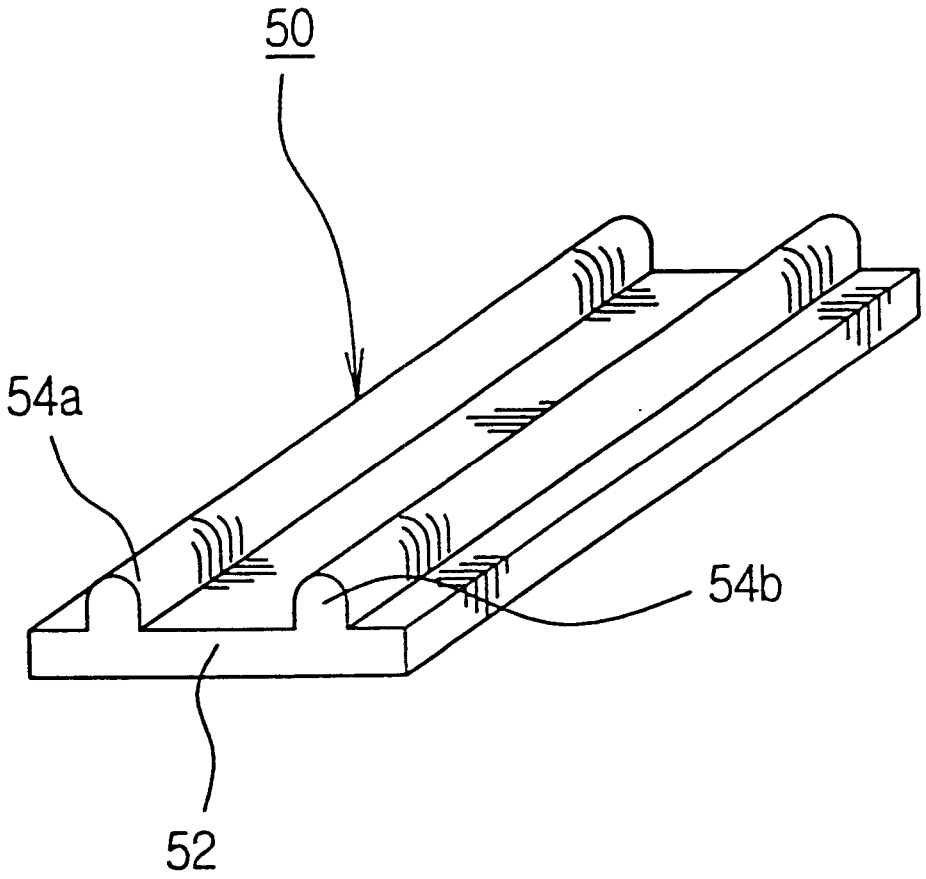
FIG. 9 is a perspective view of still another example of connection equipment for connecting concrete slab units.
Figure 10:
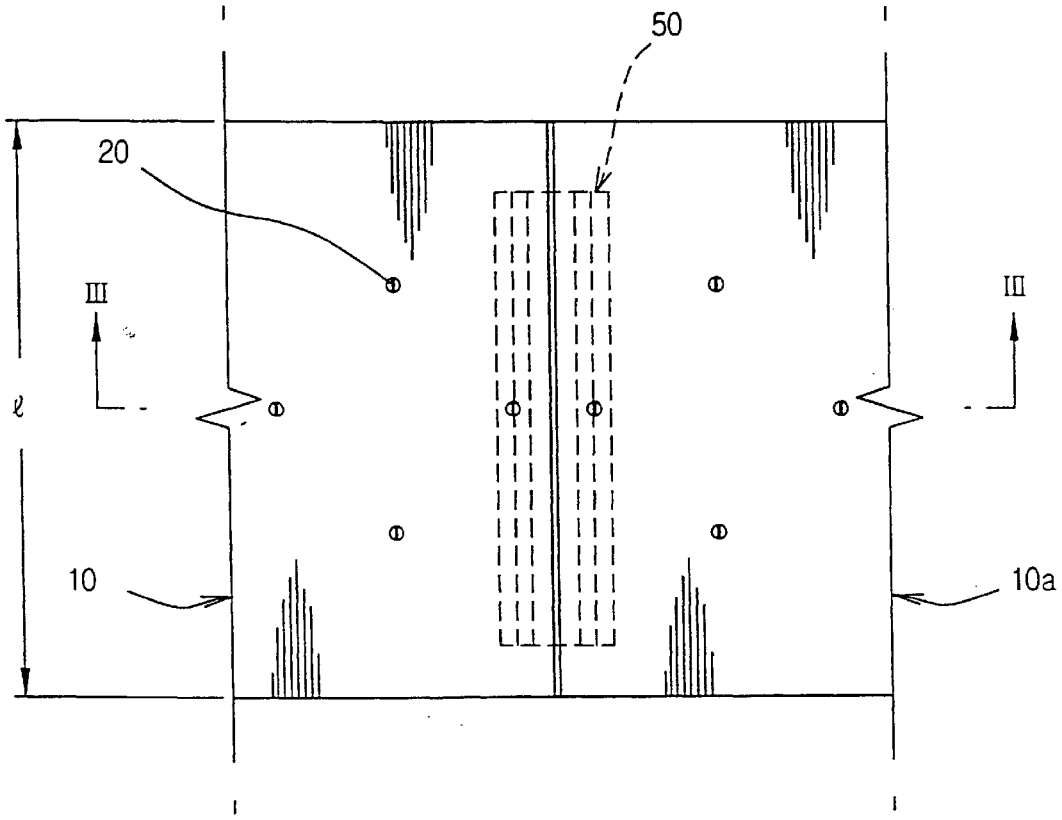
FIG. 10 is a top view showing the connection state in which concrete slab units are connected to each other by the connection equipment shown in FIG. 9.
Figure 11:
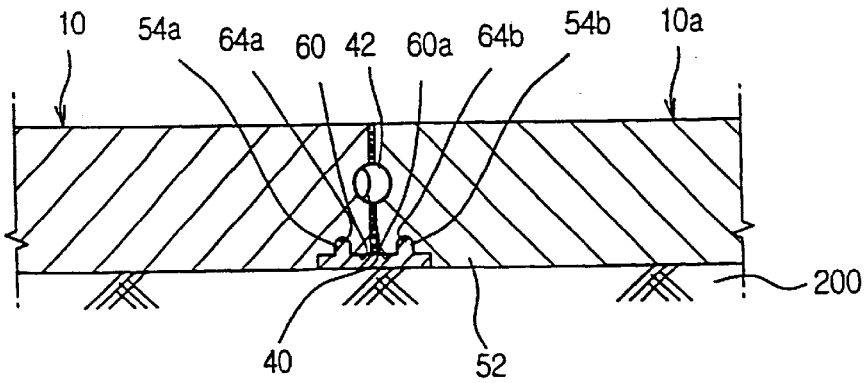
FIG. 11 is a sectional view of FIG. 10, taken along the line III—III.

FIG. 9 is a perspective view of still another connection equipment for connecting slab units, FIG. 10 is a top view showing the connection state in which slab units are connected to each other by means of the connection equipment shown in FIG. 9, FIG. 11 is a sectional view of FIG. 10, taken along the line III—III, respectively.

Another connection means for connecting neighboring slab units 10 and 10*a* without being moved, can be embodied by a substantially plate-shaped connection equipment 50. The connection equipment 50 includes a rectangular base panel 52 coplanarly accommodated in accommodating grooves 60 and 60*a* formed on the bottom of the slab units 10 and 10*a*. The accommodating grooves 60 and 60*a* are preferably formed an equal distance of the full length (l) of each of the slab units 10 and 10*a*, which is just for achieving an agreeable appearance. Projecting members 54*a* and 54*b* are integrally formed at both sides of the base panel 52 forming the connection equipment 50. The projecting members 54*a* and 54*b* support the slab units 10 and 10*a* so as not to move, such that they are inserted into recessed members 64*a* and 64*b* which are formed with more depth than the accommodating grooves 60 and 60*a*, with the connection equipment 50 being supported on the roadbed 200.

Figure 12:
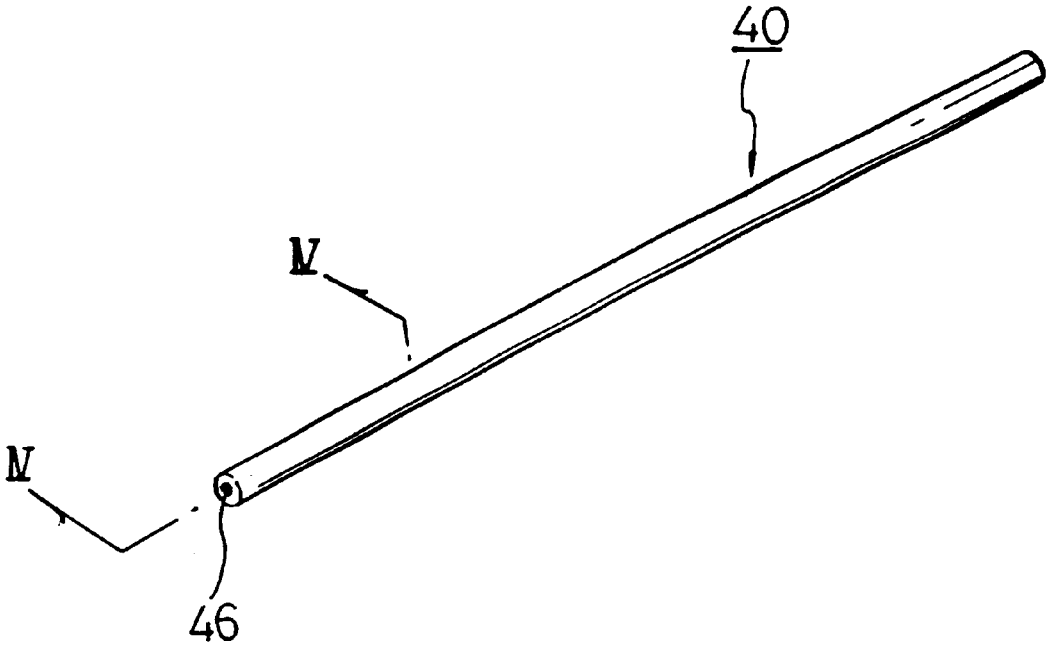
FIG. 12 is a partially extracted perspective view schematically showing a tube for providing watertightness (indicated by dotted lines shown in FIG. 1) employed to the cement concrete slab according to the present invention.
Figure 13:
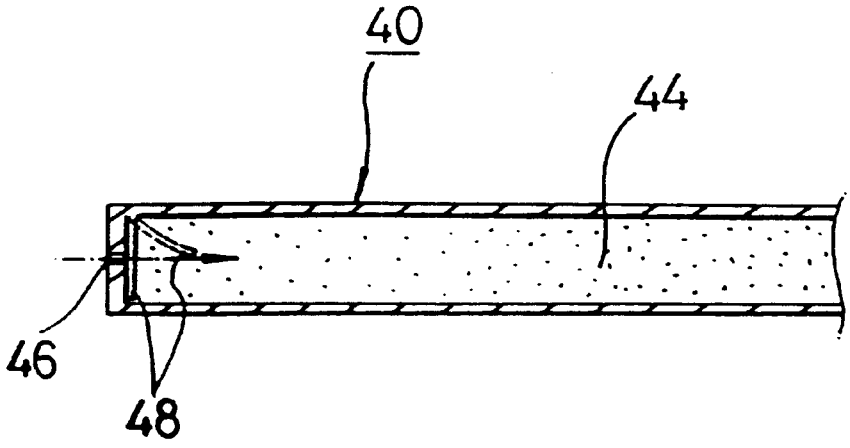
FIG. 13 is a partially enlarged sectional view taken along the line IV—IV shown in FIG. 12.

FIG. 12 is a partially extracted perspective view schematically showing a tube for providing watertightness (indicated by dotted lines shown in FIG. 1) employed to the cement concrete slab according to the present invention, and FIG. 13 is a partially enlarged sectional view taken along the line IV—IV shown in FIG. 12.

A tube 40 for providing watertightness is installed to shield water permeated into the ground, e.g., the rain, through the slab units 10, 10*a*, 10*b* and 10*c* installed on the ground, which will now be described with reference to FIGS. 1, 2, 3, 7 and 11.

The tube 40 is made of an elastic rubber into a bar shape so as to have a predetermined strength. In the tube 40 is installed an orifice 46 for injecting air or a filler 44 for watertightness thereinto. A thin-film shielding plate 48, which acts as a valve for preventing the air or filler 44 from being discharged outside, is provided inside the orifice 46. The shielding plate 48 is made of a rubber, like the tube 40, and is configured to cover the orifice 46 from the inside of the tube 40. Also, the shielding plate 48 has one end (corresponding to an upper end, when viewed from the drawing) integrally mounted on the inner wall of the tube 40 and the other end being free. Thus, the shielding plate 48 makes the orifice 46 open such that it is separated from the orifice 46 by the injection pressure when the air or filler 44 is injected through the orifice 46 of the tube 40. When injection is completed, the shielding plate 48 makes the orifice 46 of the tube 40 closed. The length of the tube 40 corresponds to the length (l) of each of the sides of the slab unit 10. Thus, the length of the tube 40 can be arbitrarily changed according to the size of each of the slab units 10, 10*a*, 10*b* and 10*c*.

The procedure of installing the tube 40 in each of the slab units 10, 10*a*, 10*b* and 10*c* will be described with reference to FIGS. 7 and 11. First, after the slab unit 10 is installed on the roadbed 200, another slab unit 10*a* is continuously installed adjacent to the slab unit 10. Then, hemispherical grooves 42 formed at one-side lateral surfaces of the slab units 10 and 10*a* unite to form a cylindrical structure having both ends opened. Thus, the tube 40 can be mounted inside the cylindrical structure formed by the hemispherical grooves 42 by inserting the tube 40 from one end of the cylindrical structure. The tube 40 is inserted into the cylindrical structure formed whenever the slab units 10, 10*a*, 10*b* and 10*c* are installed adjacent to each other. Here, the orifice 46 of the tube 40 is preferably exposed outward. This is for facilitating injection of air or filler 44 through the orifice 46. The air or filler 44 is injected through the orifice 46 using an air compressor or a filling device (not shown). The injection pressure is set to a predetermined level and can be easily identified by a pressure indicator (not shown) mounted on the air compressor or filling device. If the air or filler 44 is injected into the tube 40, the tube 40 inflates to a position indicated by an imaginary line inside a circle formed by the hemispherical grooves 42 of neighboring slab units, as shown in FIGS. 7 and 11, so that it closely contacts the wall of the hemispherical grooves 42. In such a manner, the tube 40 prevents water, e.g., the rain, from infiltrating into the roadbed 200 through gaps between the respective slab units.

The gaps present between each of the respective slab units 10, 10*a*, 10*b* and 10*c* on the tube 40 are not so big. However, for the purposes of preventing infiltration of water or providing an even pavement surface, it is preferred that the gaps maintain watertightness by separately filling the filler 70, as shown in FIGS. 7 and 11, or rubber pad into the gaps. On the other hand, referring back to FIGS. 8*b* and 8*c*, if the connection plates 32*b* and 32*c* having the walls 28, 38 are installed, it is not necessary to provide a separate pad or filler because the walls 28, 38 serves as a pad. The filler 70 including the tube 40 also functions to accommodate the slab units 10, 10*a*, 10*b* and 10*c* during expansion and contraction thereof.

Although it has been described that the respective slab units 10, 10*a*, 10*b* and 10*c* are assembled step by step for a better understanding, it is noted that they are practically installed in a continuous assembling procedure. Also, although not shown in the drawings, in any case that there is a facility installed on the roadway, e.g., manhole covers for water supply or sewage systems, a space adapted to the shape of the facility can be provided in each slab unit. Further, slab units according to the present invention can also be applied to cases of changing the width of a road, changing the cant of a road, forming a circular curve or round curve on a roadway, and so on.

As described above, according to the present invention, a roadway paved by assembling prefabricated cement concrete slab units has the following advantages over the conventional cement concrete pavement.

First, since pavement materials and curing work are easily controlled and the pavement process is mechanically controlled, durability of a roadway can be enhanced and cracks generated during curing can be minimized, thereby extending the life of the roadway.

Also, since the slab units are prefabricated accurately, they can be suitably applied to any change of a roadway, e.g., circular curve, arced curve, cant, width or thickness.

Since pavement can be completed within the period as shortest as possible, the construction period can be greatly reduced. In particular, when existing asphalt concrete pavement is intended to replace cement concrete pavement, traffic regulation can be minimized.

Further, unlike the conventional pavement technology in which a public facility on a roadway must be demolished for repair and maintenance, a bad appearance and uneven road surface may be resulted even after completion of pavement, the present invention pavement can be recycled, the construction cost thereof can be greatly reduced and a uniform pavement surface can be achieved.

Since lane marking or guide line marking is achieved by engraving a road surface for lane painting and anti-slip equipment is fixed on the road surface whenever necessary, lane or guide line marking or installation of anti-slip equipment can be performed semi-permanently.

Further, according to the present invention, difficulties in repair and maintenance of severely damaged concrete cement pavement and traffic hindrance during a repair and maintenance period, often occurring in the conventional technology, can be solved.

Damages associated with conventional asphalt concrete pavement, in particular on roads where heavy vehicles frequently pass, e.g., industrial roadways or roads about industrial complexes, or crossroads where vehicular stoppages or standbys are continuously repeated, can be overcome. Also, spoiled appearance due to rutting or shoving and inconvenience of running vehicles due to water gathering in the rainy season, can be solved.

Since the road surface is clear, a driver's sight distance can be advantageously ensured at night. Also, in the case where the present invention is applied for pavement of city roadways, the appearance of the city can be improved.

What is claimed is:

1. A prefabricated cement concrete slab for road pavement, in a roadway treated with a previous compaction work, comprising:

rectangular cement concrete slab units prefabricated into a transportable size adapted to the width of a lane, and configured for road pavement by horizontally arranging neighboring slab units along a roadbed;

lifting means providing latching holes integrally formed in the respective slab units for transporting the slab units;

connecting means positioned on a roadbed facing joint portions of the neighboring slab units for fixedly connecting the slab units without being moved; and a tube mounted inside a cylindrical structure formed by hemispherical grooves formed at one-side lateral surfaces of the neighboring slab units horizontally connected by the connecting means, and having a valve for filling air or a watertight filler for providing watertightness to the slab units.

2. The concrete slab according to claim 1, wherein the valve includes an orifice formed on the tube, and a shield plate installed around the orifice, for opening/closing the orifice.

3. The concrete slab according to claim 1, wherein each of the lifting means includes a support plate having a predetermined area and horizontally buried into the slab unit.

4. The concrete slab according to claim 2, wherein each of the lifting means includes a support tube welded to the support plate and buried into the slab unit to form an accommodating groove opened outward through an opening.

5. The concrete slab according to claim 4, wherein the accommodating groove includes an openable cap.

6. The concrete slab according to claim 5, wherein each of the lifting means includes a latching device having a latching hole inside the accommodating groove firmly welded on the support plate and the latching device being exposed outward through the opening when the cap is opened.

7. A prefabricated cement concrete slab for road pavement, in a roadway treated with a previous compaction work, comprising:

rectangular cement concrete slab units prefabricated into a transportable size adapted to the width of a lane, and configured for road pavement by horizontally arranging neighboring slab units along a roadbed;

lifting means providing latching holes integrally formed in the respective slab units for transporting the slab units, said lifting means including a support plate having a predetermined area and horizontally buried into the slab unit, and a support tube integrally welded to the support plate and buried into the slab unit to form an accommodating groove opened outward through an opening, the accommodating groove having an openable cap threaded thereto;

a latching device having a latching hole inside the accommodating groove firmly welded on the support plate and the latching device being exposed outward through the opening when the cap is opened;

connecting means positioned on a roadbed facing joint portions of the neighboring slab units for fixedly connecting the slab units without being moved; and a tube mounted inside a cylindrical structure formed by hemispherical grooves formed at one-side lateral surfaces of the neighboring slab units horizontally connected by the connecting means, and having a valve for filling air or a watertight filler for providing watertightness to the slab units.

8. The concrete slab according to claim 7, wherein said latching device includes a thread rod firmly welded on the support plate and wherein said latching hole is separably threaded to said thread rod.

9. The concrete slab according to claim 7, wherein said latching hole includes a recessed groove formed on the top surface of the cap to have a predetermined area and pivotally supported to the inner wall of the recessed groove to lie down inside the recessed groove.

10. The concrete slab according to claim 7, further comprising a hole for opening/closing on the top surface of the cap.

11. A prefabricated cement concrete slab for road pavement, in a roadway treated with a previous compaction work, comprising:

rectangular cement concrete slab units prefabricated into a transportable size adapted to the width of a lane, and configured for road pavement by horizontally arranging neighboring slab units along a roadbed;

lifting means providing latching holes integrally formed in the respective slab units for transporting the slab units;

connecting means positioned on a roadbed facing joint portions of the neighboring slab units for fixedly connecting the slab units without being moved, said connecting means including an accommodating groove formed on a base facing a portion adjacent to the slab units, a rectangular connection plate coplanarly accommodated in an accommodating groove and having insertion pins protruding thereon, and an insertion equipment installed at a portion facing the connection plate of the slab unit and having insertion holes into which the insertion pins are inserted; and a tube mounted inside a cylindrical structure formed by hemispherical grooves formed at one-side lateral surfaces of the neighboring slab units horizontally connected by the connecting means, and having a valve for filling air or a watertight filler for providing watertightness to the slab units.

12. The concrete slab according to claim 11, wherein a wall for providing watertightness is further provided between the slab units in a straight-line form or cross form.

13. The concrete slab according to claim 11, further comprising a bar-shaped reinforcement member further installed along the outer periphery of the insertion equipment.

14. A prefabricated cement concrete slab for road pavement, in a roadway treated with a previous compaction work, comprising:

rectangular cement concrete slab units prefabricated into a transportable size adapted to the width of a lane, and configured for road pavement by horizontally arranging neighboring slab units along a roadbed;

lifting means providing latching holes integrally formed in the respective slab units for transporting the slab units;

connecting means positioned on a roadbed facing joint portions of the neighboring slab units for fixedly connecting the slab units without being moved, said connection means including an accommodating groove formed on the bottom portions of the neighboring slab units, a recessed member formed in the accommodating groove, a rectangular base panel coplanarly accommodated in the accommodating groove, and a first and second projecting member integral with and extending from the base panel; and a tube mounted inside a cylindrical structure formed by hemispherical grooves formed at one-side lateral surfaces of the neighboring slab units horizontally connected by the connecting means, and having a valve for filling air or a watertight filler for providing watertightness to the slab units.

* * * * *